US006192815B1

(12) United States Patent
Duttenhofer

(10) Patent No.: US 6,192,815 B1
(45) Date of Patent: Feb. 27, 2001

(54) PUSH-BUTTON ON A SEWING MACHINE

(75) Inventor: Bernhard Duttenhofer, Bruchsal (DE)

(73) Assignee: G.M. Pfaff AG (DE)

( * ) Notice: Subject to any disclaimer, the term of this patent is extended or adjusted under 35 U.S.C. 154(b) by 0 days.

(21) Appl. No.: 09/475,898

(22) Filed: Dec. 30, 1999

(30) Foreign Application Priority Data

Jul. 27, 1999 (DE) ..... 299 07 407 U

(51) Int. Cl.[7] ..... D05B 69/10
(52) U.S. Cl. ..... 112/277; 200/341
(58) Field of Search ..... 112/270, 1, 258, 112/259, 277; 200/16 R, 16 B, 16 C, 16 E, 50.02, 51.13, 293, 303, 333, 341

(56) References Cited

U.S. PATENT DOCUMENTS 3,939,318 * 2/1976 Brown et al. ..... 200/341 X
4,055,131 * 10/1977 O'Brien et al. ..... 112/258 X
4,100,867 * 7/1978 Bass et al. ..... 112/270
4,485,282 * 11/1984 Lee ..... 200/293 X
4,988,553 * 1/1991 Saiki et al. ..... 200/293 X
5,520,128 * 5/1996 Rich et al. ..... 112/277

* cited by examiner

*Primary Examiner*—Ismael Izaguirre
(74) *Attorney, Agent, or Firm*—McGlew and Tuttle, P.C.

(57) ABSTRACT

A push-button on a sewing machine is provided with a bracket rigidly connected to a sewing machine housing. A key member is mounted axially displaceably in a hole of the bracket with a stop for limiting its outwardly directed displacement and with a switch. The switch may be arranged on the bracket and can be actuated by the key member. The key member has a key stop for limiting its displacement directed toward the interior of the housing. An elastic hook-shaped holding mechanism extends into the displacement path of the key stop and fixes the switch supported on the bracket. The elastic hook-shaped holding mechanism is arranged on the bracket.

16 Claims, 1 Drawing Sheet

PUSH-BUTTON ON A SEWING MACHINE

FIELD OF THE INVENTION

The present invention pertains to a push-button on a sewing machine with a said bracket rigidly connected to the sewing machine housing with a key member mounted axially displaceably in a hole of the bracket with a stop for limiting its outwardly directed displacement and with a switch, which can be arranged on the bracket and can be actuated by the key member.

BACKGROUND OF THE INVENTION

Electrically driven sewing machines sometimes have a plurality of push-buttons, which serve various purposes, e.g., to enter information, to select sewing programs stored in a memory, or to perform adjusting functions. It is expedient to arrange push-buttons that are frequently needed and to be actuated during sewing, e.g., the switch for reversing the direction of feed of the feeder, in the reaching area of operator's hands, i.e., directly above the stitch formation site in or on the head of the sewing machine housing. However, the space conditions are usually crowded in this area of the sewing machine housing or the area in which the push-button is to be mounted is poorly accessible. The installation of push-buttons especially in this area of the sewing machine housing is comparatively cumbersome and time-consuming.

SUMMARY AND OBJECTS OF THE INVENTION

The basic object of the present invention is to provide a push-button that can be mounted in a simple manner even in poorly accessible areas of a sewing machine housing.

According to the invention, a push-button on a sewing machine is provided with a bracket rigidly connected to a sewing machine housing. A key member is mounted axially displaceably in a hole of the bracket with a stop means for limiting its outwardly directed displacement and with a switch. The switch may be arranged on the bracket and can be actuated by the key member. The key member has a key stop for limiting its displacement directed toward the interior of the housing. An elastic hook-shaped holding mechanism (holding means) extends into the displacement path of the key stop and fixes the switch supported on the bracket. The elastic hook-shaped holding mechanism is arranged on the bracket.

The key stop may be formed by a stop face of two flattened areas, which extend transversely or obliquely to the direction of displacement of the key member. The switch may be fastened to a board. The board is kept in contact with the rear side of the bracket by the hook-shaped holding means. The hook-shaped holding means may be formed by elastic fingers. These fingers may be provided as an integral part of the bracket.

The switch may have a spring-loaded switch element (known per se). The spring-loaded switch element may be used as a resetting means for the key.

The present invention is based essentially on the idea of providing the bracket of the push-button, which is rigidly connected to the sewing machine housing, with elastic holding means, which are used to provisionally hold the key, on the one hand, and to fix the switch, on the other hand, when the switch is in its intended fitting position, in which it is supported on the bracket and also cooperates with the key at the same time. The key can thus be preassembled from the inside of the housing without the risk of slipping out of the bracket and falling into the interior of the housing later.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figures 1, 2, 3:
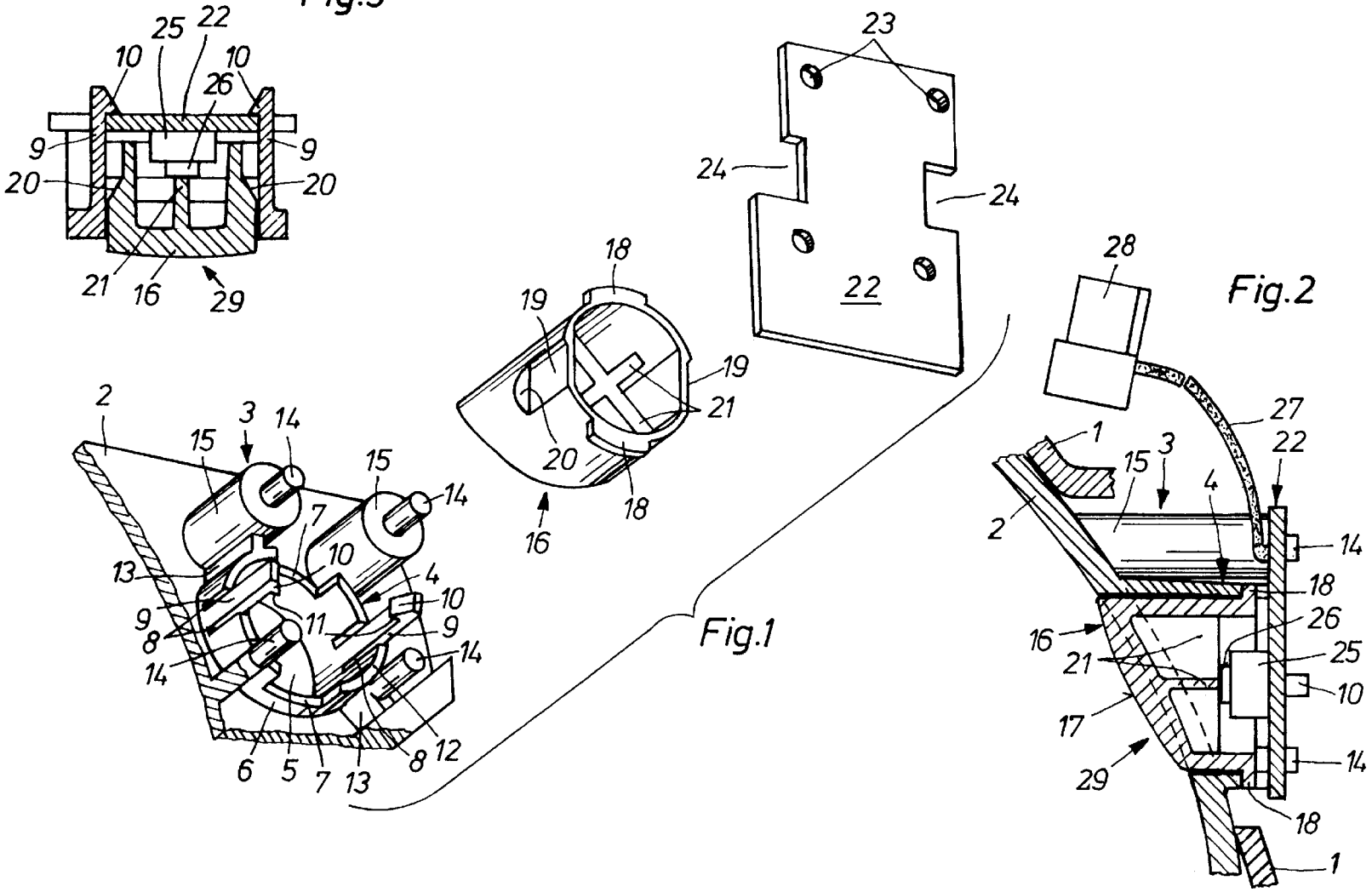
FIG. 1 is an exploded view of the push-button.
FIG. 2 is a sectional representation of the push-button with vertically extending sectional plane.
FIG. 3 is a sectional representation with horizontally extending sectional plane.

Referring to the drawings in particular, the sewing machine has, e.g., an injection-molded housing skeleton 1, of which only a small part is shown in the drawing. The housing skeleton 1 is used as a carrier for the sewing tools/parts and transmission parts, which are parts known per se and that are therefore not shown. The housing skeleton 1 is surrounded by a housing shell 2 divided into a plurality of sections. Only part of the front housing shell 2 associated with the head area of the sewing machine is shown in the drawing.

A bracket 3 is provided on the inside of the housing shell 2. It has a tubular projection 4 with a hole. Two rectangular incisions 7 arranged opposite each other are contained in the wall 6 of the projection 4. Two holding fingers 9, which are an integral part of the bracket 3 and the housing shell 2, are arranged in two other recesses 8 of the wall 6, which reach up to the inside of the housing shell 2. The cross section of the holding fingers 9 is selected to be such that they are elastically flexible in the radial direction to the projection 4. One inwardly projecting, beveled hook 10 is provided on each finger 9. These hooks 10 have a transversely extending holding surfaces 11, located at a spaced location from the front side 12 of the projection 4. The beveled hooks 10 are provided at the free end of the holding fingers 9.

The wall 6 of the projection 4 is supported by four outer stiffening ribs 13 arranged in a crosswise pattern. The two upper stiffening ribs 13 are connected to a support 15 of a larger diameter each, which in turn carry a pin 14 each.

A correspondingly shaped key or key member 16 is displaceably accommodated in the hole 5. The key 16 has a contact surface 17 and, on the circumferential side, two transversely offset dogs 18, which engage the incisions 7. The dogs 18 thus form first holding means for the key 16, which limit their outwardly directed displacement within the projection 4. Two flattened areas 19, which are located opposite each other and are limited by an obliquely extending stop face 20 each, are provided on the circumferential side of the key 16 between the dogs 18. The stop faces 20 form second stop means, which limit the inwardly directed displacement of the key 16 in conjunction with the holding fingers 9. Stiffening ribs 21 arranged in a crosswise pattern are provided inside the key 16.

A microswitch 25 is fastened on a board 22, which has four mounting holes 23 for the pins 14 as well as two recesses 24 for receiving the holding fingers 9. The microswitch 25 contains a spring-loaded, axially displaceable switching element 26 in the known manner, The microswitch 25 is in connection with a plug 28 via a line 27.

The bracket 3, the key 16, and the board 22 with the switch 25 together form a push-button 29.

To mount the push-button 29, the key 16 is pushed into the projection 4 of the bracket 3 from the inner side with the housing shell 2 not yet mounted, while the holding finger 9 will elastically yield. As soon as the stop faces 20 of the flattened areas 19 have passed by the hooks 10, the holding fingers 9 spring back into their normal position, after which the hooks 10 grip behind the stop faces 20, thus limiting the inwardly directed displacement of the key 16 and preventing in this way the key 16 from slipping out of the bracket 3.

After the assembly of the sewing machine, i.e., after the mounting of the sewing tools and transmission parts, the housing shell 2 is fastened together with the inserted key 16 to the housing skeleton 1 in the known manner. The board 22 with its mounting holes 23 is then attached to the pins 14 until it comes into contact with the front side 12 of the projection 4. The holding fingers 9 yield elastically while the board 22 is being pushed on. The above-mentioned distance between the transversely extending holding faces 11 of the hooks 10 and the front side 12 of the projection 4 is selected to be such that it is slightly greater than the thickness of the board 22. The consequence of this is that after the board 22 has come into contact with the front side 12, the holding fingers 9 spring back into their normal position and fix the board 22 in the inserted position. In this position of the board 22, in which it is locked by the holding fingers 9, the spring-loaded switch element 26 is in contact with the stiffening ribs 21 of the key 16 and pushes same to the outer end of this displacement path, which is limited, as was mentioned before, by the dogs 18 engaging the incisions 7. The switch 25 is in the switched-off position in this position of the key 16. By actuating the key 16, the spring-loaded switch element 26 is pushed back and the switch 25 is moved into the other switching state.

While a specific embodiment of the invention has been shown and described in detail to illustrate the application of the principles of the invention, it will be understood that the invention may be embodied otherwise without departing from such principles.

What is claimed is:

1. A sewing machine push-button, comprising:

a bracket rigidly connected to a sewing machine housing;

a key mounted axially displaceably in a hole of said bracket, with a stop for limiting outwardly directed displacement of said key and a key stop for limiting key displacement directed toward an interior of said housing;

a switch arranged on said bracket and being actuatable by said key;

an elastic hook-shaped holding means extending into a displacement path of said key stop and fixing said switch supported on said bracket, said elastic hook-shaped holding means being arranged on said bracket.

2. The push-button in accordance with claim 1, wherein said key stop is includes a stop face having two flattened areas extending transversely or obliquely to the direction of displacement of said key.

3. The push-button in accordance with claim 1, further comprising a board, wherein said switch is fastened to said board, said board being maintained in contact with a rear side of said bracket by said hook-shaped holding means.

4. The push-button in accordance with claim 2, further comprising a board, wherein said switch is fastened to said board, said board being maintained in contact with a rear side of said bracket by said hook-shaped holding means.

5. The push-button in accordance with claim 1, wherein said hook-shaped holding means is formed by elastic fingers.

6. The push-button in accordance with claim 5, wherein said elastic fingers are an integral part of said bracket.

7. The push-button in accordance with claim 2, wherein said hook-shaped holding mechanism is formed by elastic fingers that are an integral part of said bracket.

8. The push-button in accordance with claim 3, wherein said hook-shaped holding mechanism is formed by elastic fingers that are an integral part of said bracket.

9. The push-button in accordance with claim 1, wherein said switch has a spring-loaded switch element used as a resetting means for resetting a position of said key member.

10. The push-button in accordance with claim 2, wherein said switch has a spring-loaded switch element used as a resetting means for resetting a position of said key member.

11. The push-button in accordance with claim 3, wherein said switch has a spring-loaded switch element used as a resetting means for resetting a position of said key member.

12. A push-button, comprising:

a bracket rigidly connected to a housing;

a key member mounted axially displaceably in a hole of said bracket with a stop for limiting outwardly directed displacement of said key member and a key stop for limiting key displacement directed toward an interior of said housing;

a switch arranged on said bracket and being actuatable by said key member;

an elastic hook-shaped holding mechanism extending into a displacement path of said key stop and fixing said switch supported on said bracket, said elastic hook-shaped holding mechanism being arranged on said bracket.

13. The push-button in accordance with claim 12, wherein said key stop is includes a stop face having two flattened areas extending transversely or obliquely to the direction of displacement of said key member.

14. The push-button in accordance with claim 12, further comprising a board, wherein said switch is fastened to said board, said board being kept in contact with a rear side of said bracket by said hook-shaped holding mechanism.

15. The push-button in accordance with claim 12, wherein said hook-shaped holding mechanism is formed by elastic fingers that are an integral part of said bracket.

16. The push-button in accordance with claim 12, wherein said switch has a spring-loaded switch element used as a resetting means for resetting a position of said key member.

* * * * *